US010236599B2

(12) United States Patent
Zhao

(10) Patent No.: US 10,236,599 B2
(45) Date of Patent: Mar. 19, 2019

(54) GROUNDING COLLAR CONNECTED WITH GROUNDING TERMINAL

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/831,361

(22) Filed: Dec. 4, 2017

(65) Prior Publication Data

US 2018/0159250 A1 Jun. 7, 2018

(30) Foreign Application Priority Data

Dec. 2, 2016 (CN) ..... 2016 2 1318856 U

(51) Int. Cl.

| | |
|---|---|
| ***H01R 9/03*** | (2006.01) |
| ***H01R 13/502*** | (2006.01) |
| ***H01R 13/6582*** | (2011.01) |
| ***H01R 4/02*** | (2006.01) |
| ***H01R 43/20*** | (2006.01) |
| *H01R 13/6587* | (2011.01) |

(Continued)

(52) U.S. Cl.

CPC ..... *H01R 9/034* (2013.01); *H01R 4/027* (2013.01); *H01R 13/502* (2013.01); *H01R 13/6582* (2013.01); *H01R 43/20* (2013.01); *H01R 12/716* (2013.01); *H01R 12/724* (2013.01); *H01R 13/506* (2013.01); *H01R 13/5219* (2013.01); *H01R 13/6275* (2013.01); *H01R 13/6587* (2013.01); *H01R 24/60* (2013.01); *H01R 43/24* (2013.01); *H01R 2107/00* (2013.01)

(58) Field of Classification Search

CPC .. H01R 9/034; H01R 13/502; H01R 13/6587; H01R 24/60

USPC ..... 439/92

See application file for complete search history.

(56) References Cited

U.S. PATENT DOCUMENTS

| | | | | |
|---|---|---|---|---|
| 9,935,401 | B2 * | 4/2018 | Tsai | H01R 13/652 |
| 9,972,952 | B2 * | 5/2018 | Guo | H01R 24/60 |

(Continued)

FOREIGN PATENT DOCUMENTS

| | | |
|---|---|---|
| CN | 204835065 U | 12/2015 |
| CN | 205355339 | 6/2016 |

*Primary Examiner* — Alexander Gilman

(74) *Attorney, Agent, or Firm* — Wei Te Chung; Ming Chieh Chang

(57) ABSTRACT

An electrical connector assembly includes an insulative housing, a plurality of terminals retained in the housing, and a metallic shielding plate embedded within the housing. The insulative housing includes a base and a tongue portion extending forwardly from the base. The tongue portion includes a mating section and a rear step section. There are two rows of terminals. The shielding plate is disposed between the two rows of terminals. The terminals include a pair of outermost grounding terminals in a transverse direction. A grounding plate positioned upon the rear step section, is mechanically and electrically connected to at least one of the corresponding grounding terminal and the shielding plate wherein the corresponding grounding terminal and the shielding plate have corresponding extension soldered to the grounding plate.

13 Claims, 17 Drawing Sheets

(51) Int. Cl.

| | |
|---|---|
| *H01R 24/60* | (2011.01) |
| *H01R 12/71* | (2011.01) |
| *H01R 13/627* | (2006.01) |
| *H01R 107/00* | (2006.01) |
| *H01R 12/72* | (2011.01) |
| *H01R 13/506* | (2006.01) |
| *H01R 13/52* | (2006.01) |
| *H01R 43/24* | (2006.01) |

(56) References Cited

U.S. PATENT DOCUMENTS

2014/0073184 A1* 3/2014 Zhao ..... H01R 13/6594
439/607.55
2015/0087165 A1* 3/2015 Yu ..... H01R 12/724
439/78
2015/0194772 A1* 7/2015 Little ..... H01R 13/6597
439/357
2015/0229077 A1* 8/2015 Little ..... H01R 12/724
439/78
2015/0244111 A1* 8/2015 Ju ..... H01R 13/6585
439/607.05
2015/0364883 A1* 12/2015 Yu ..... H01R 24/70
439/607.27
2017/0271823 A1* 9/2017 Zhao ..... H01R 13/6596
2017/0365961 A1* 12/2017 Zhao ..... H01R 13/5202

* cited by examiner

GROUNDING COLLAR CONNECTED WITH GROUNDING TERMINAL

1. FIELD OF THE DISCLOSURE

The invention is related to an electrical connector, and particularly to the electrical connector with the grounding collar mechanically and electrically connected to at least one of the grounding terminal or the shielding plate.

2. DESCRIPTION OF RELATED ARTS

Chinese patent application publication CN205355339 discloses the electrical connector with a grounding collar soldered upon two oppose side edges of the shielding plate. Similarly, CN204835065 discloses the grounding collar soldered to or unitarily formed with the shielding plate, thus resulting in difficulties of assembling the corresponding terminals upon the contact module via an insert-molding process.

It is desired to provide an electrical connector with a reliable mechanical and electrical connection between the grounding collar and the shielding plate therebetween.

SUMMARY OF THE DISCLOSURE

To achieve the above desire, an electrical connector assembly for mounting upon a prince circuit board includes an insulative housing, a plurality of terminals retained in the housing, and a metallic shielding plate embedded within the housing. The insulative housing includes a base and a tongue portion extending forwardly from the base. The tongue portion includes a mating section and a rear step section connected between the mating section and the base. The terminal includes a contacting section exposed upon the mating section, a retaining section retained in the rear section and in the base, and a soldering section extending out of the base. There are two rows of terminals. The shielding plate is disposed between the two rows of terminals. The terminals include a pair of outermost grounding terminals. A grounding plate positioned upon the rear step section, is mechanically and electrically connected to at least one of the corresponding grounding terminal and the shielding plate.

The grounding plate includes a main part with contacting face exposed upon the rear step section, and a connection part formed on two opposite sides of the main part in the transverse direction to mechanically and electrically connect to the at least one of the corresponding grounding terminal and the shielding plate.

DETAILED DESCRIPTION OF THE PREFERRED EMBODIMENT

Figure 1:
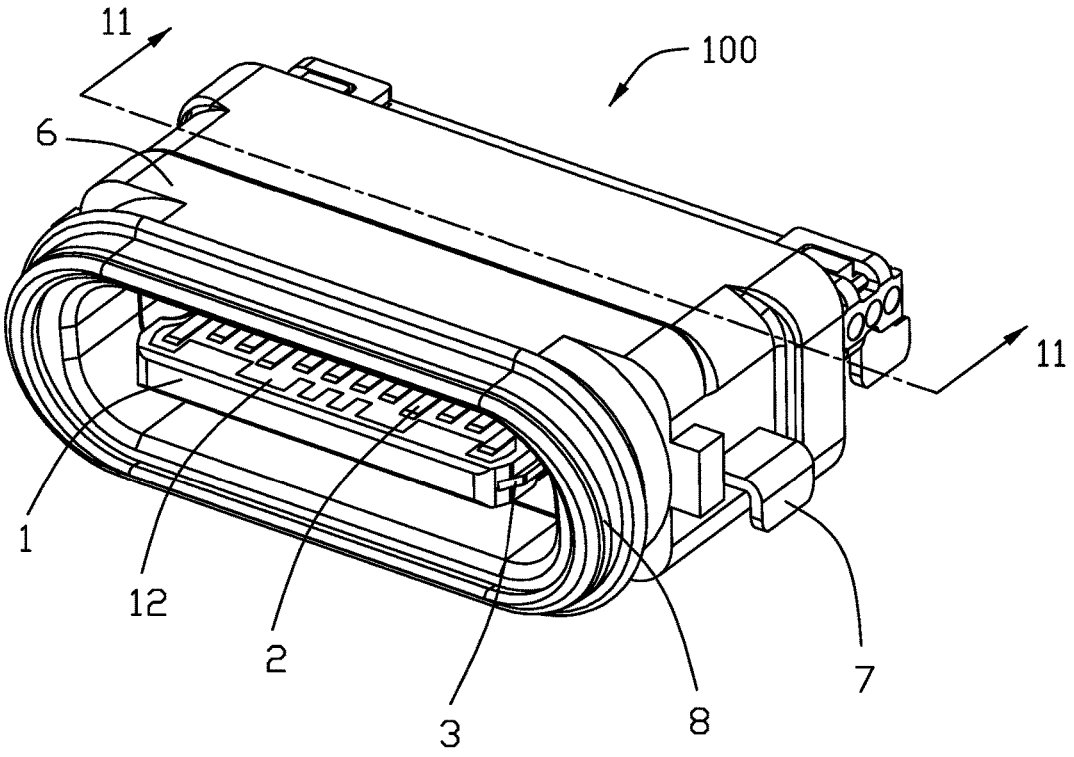
FIG. 1 is a front perspective view of an electrical connector according to a first embodiment of the invention.
Figure 2:
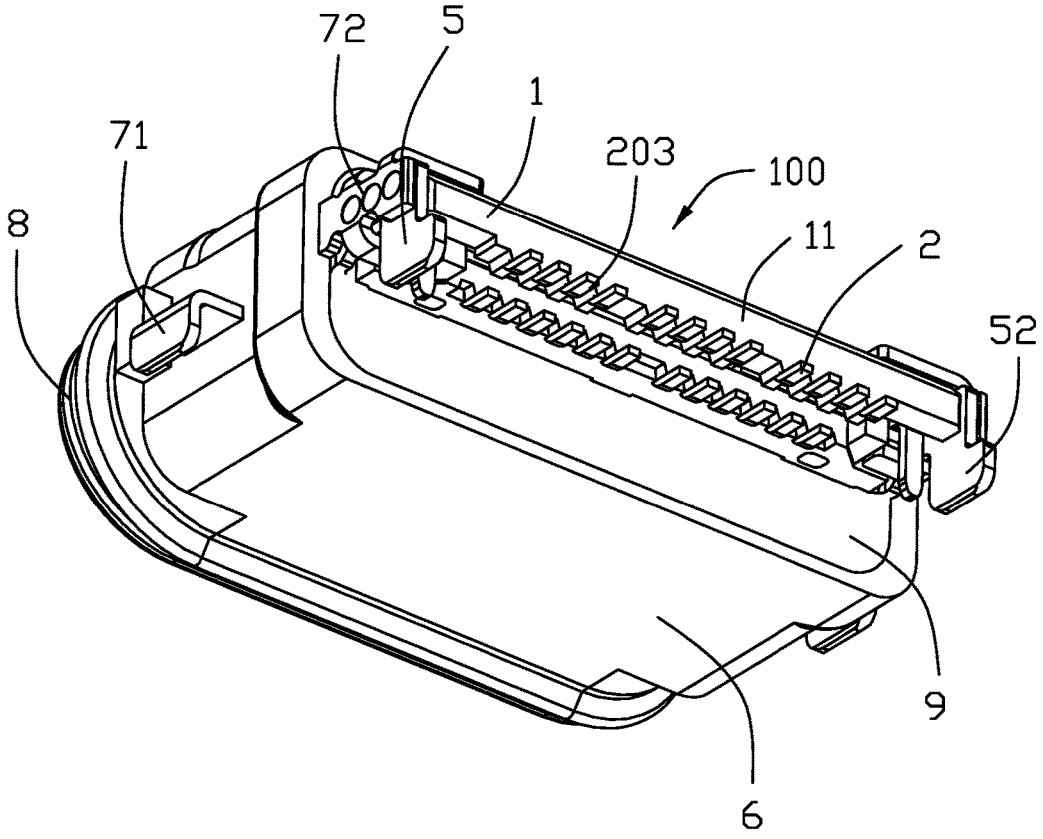
FIG. 2 is a rear perspective view of the electrical connector of FIG. 1.

Reference will now be made in detail to the embodiments of the present disclosure. Referring to FIGS. 1-11, an electrical connector 100 for mounting t a printed circuit board (not shown) defines a mating direction along a front-to-back direction, and a transverse direction perpendicular to the front-to-back direction. The connector 100 includes an insulative housing 1, a plurality of terminals 2 retained in the housing 1, and a metallic shielding plate 3 embedded within the housing 1, a grounding plate 4 secured to the housing 2, a metallic shield 5 surrounding the housing 1, and an insulative cover 6 enclosing the metallic shield 5 and equipped with a pair of mounting legs 7.

The insulative housing 1 includes a base 11 and a tongue portion 12 forwardly extending therefrom along a front-to-back direction. The tongue portion 12 includes a front mating section 121 and a rear step section 122 linked to the base 11. The mating section 121 further includes a pair of mating recesses 1211. The insulative housing 1 further includes an upper seat 13 and a lower seat 14 and an insulator 14. The upper seat 13, the lower seat 14 and the insulator 15 respectively form the first tongue 131, the second tongue 141 and the third tongue 151 commonly forming the tongue portion 12. The first tongue 131, the second tongue 141 and the third tongue 151 respectively include the first rear step 1311, the second step 1411 and the third step 1511 commonly forming the rear step section 122.

Referring to FIGS. 5-10, the terminals 2 include the upper contacts 21 and the lower contacts 22. The terminal 2 includes the contacting section 201 exposed upon the mating section of the tongue portion 12, a retaining section 202 retained in the rear step section 122 and the base 11, and a soldering section 203 extending out of the base 11. The upper contacts 21 and the lower contacts 22 are arranged in a reverse symmetrical manner to allow dual orientation insertion. Each set of the upper contacts 21 and the lower contacts 22 include a pair of outermost grounding contacts 23 and a pair of power contacts 24 therebetween.

The shielding plate 3 is metallic. The shielding plate 3 includes a main body 31 and a pair of soldering legs 32 extending from the main body 31 and out of the base 11 for mounting to the printed circuit board (not shown). The main body 31 includes a pair of protrusions 311 and a pair of locking recesses 312 behind the protrusions 311. In this embodiment, the shielding plate 3 includes a pair of pieces spaced from each other without approaching the power contacts. 24.

Referring to FIGS. 5-11, the upper seat 13 and the upper contacts 21 are integrally formed together as an upper unit via an insert-molding process, and the lower seat 14 and the lower contacts 22 are integrally formed together as a lower unit via another insert-molding process. The upper unit and the lower unit assembled together with the shielding plate 3 sandwiched therebetween and integrally formed together via an overmolding process with the insulator 15. The protrusions 311 of shielding plate 3 are exposed upon the protrusions of the mating section 121, and the locking recesses 312 of the shielding plate 3 are exposed in the mating recesses 1211 so as to be coupled with the latches of the complementary plug connector (not shown) for avoiding damage to the tongue portion 12.

Referring to FIGS. 5 and 7-11, the grounding plate 4 is metallic. The shielding plate 4 includes a main part 41 and a pair of coupling parts 42 on two lateral sides. The grounding plate 4 is embedded within the rear step section 122 of the tongue portion 12. The insulator 15 covers the pair of coupling parts 42 while exposing the main part 41. In this invention, the coupling parts 42 are mechanically and electrically connected with at least one of the grounding contact 23 and the shielding plate 3, or both.

Figure 3:
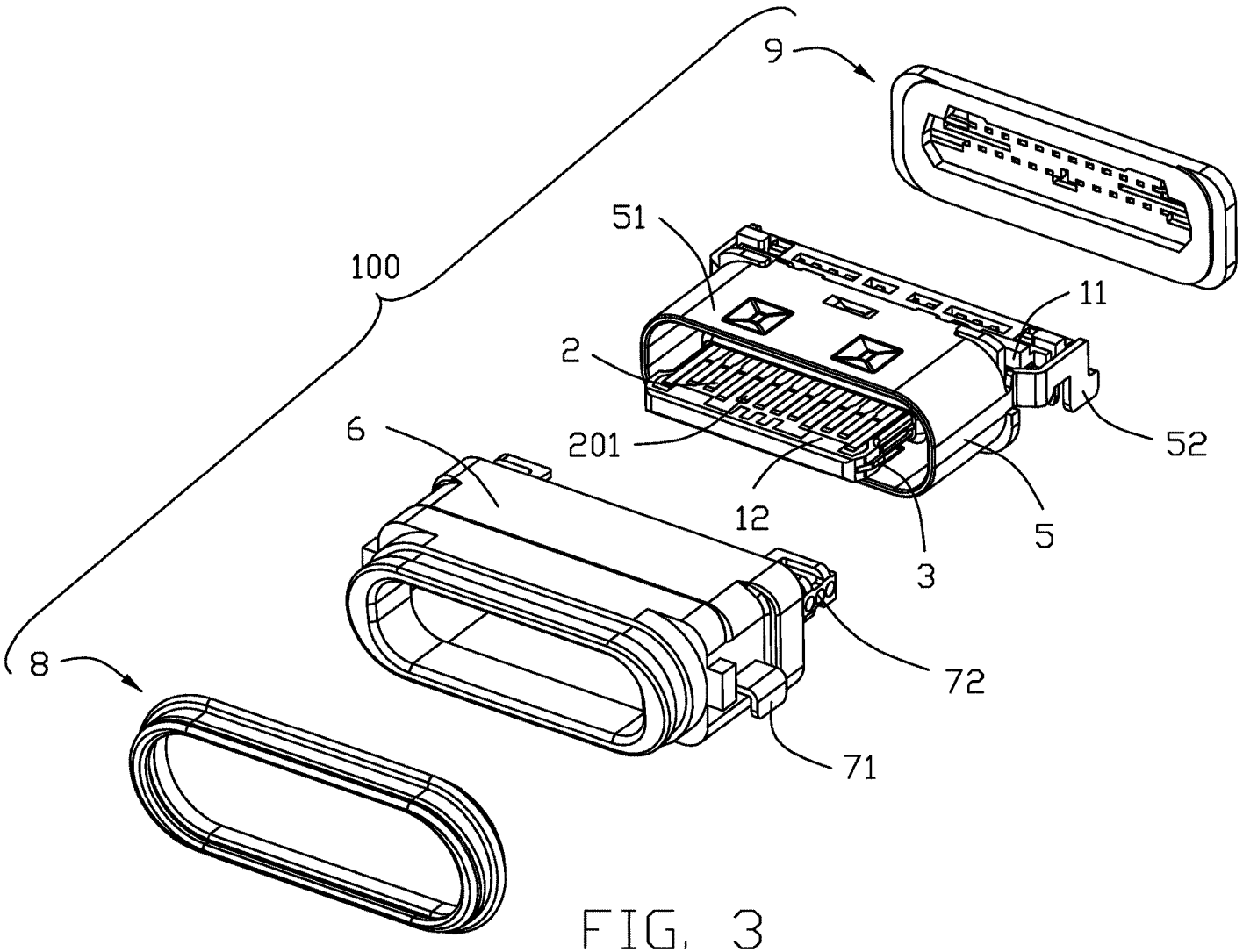
FIG. 3 is an exploded perspective view of the electrical connector of FIG. 1.
Figure 4:
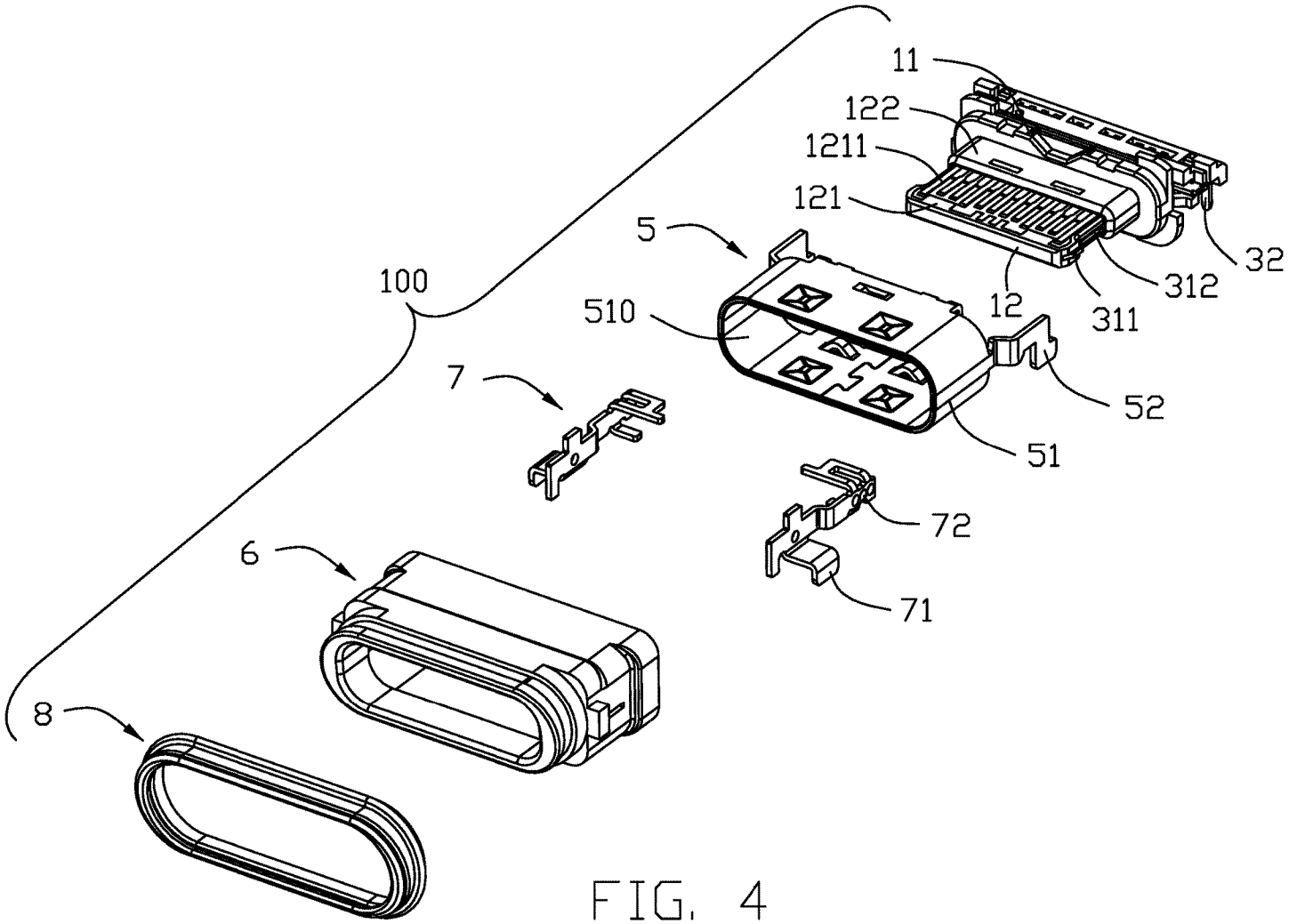
FIG. 4 is a further exploded perspective view of the electrical connector of FIG. 1.
Figure 5:
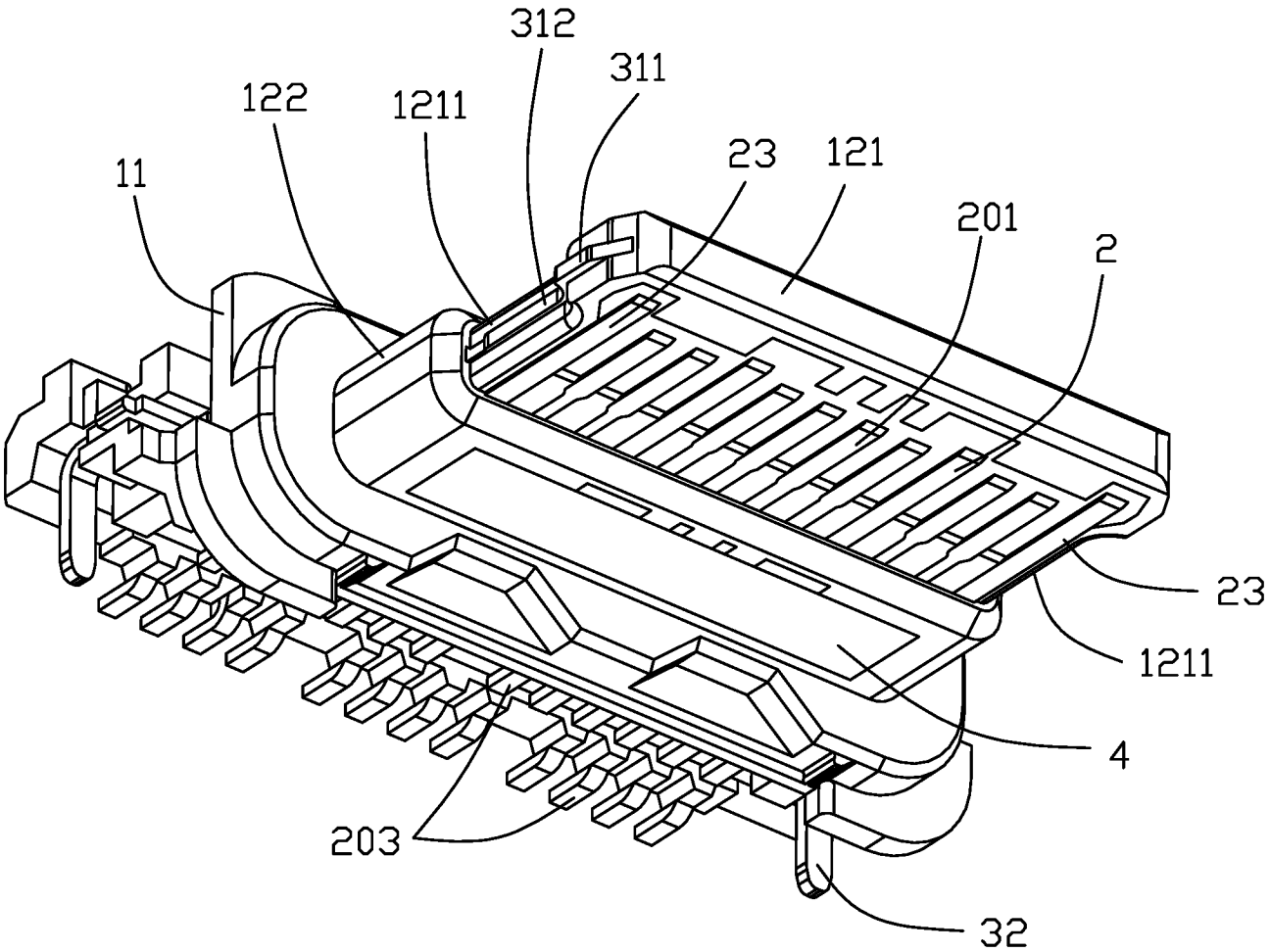
FIG. 5 is a perspective view of the contact module of the electrical connector.
Figure 6:
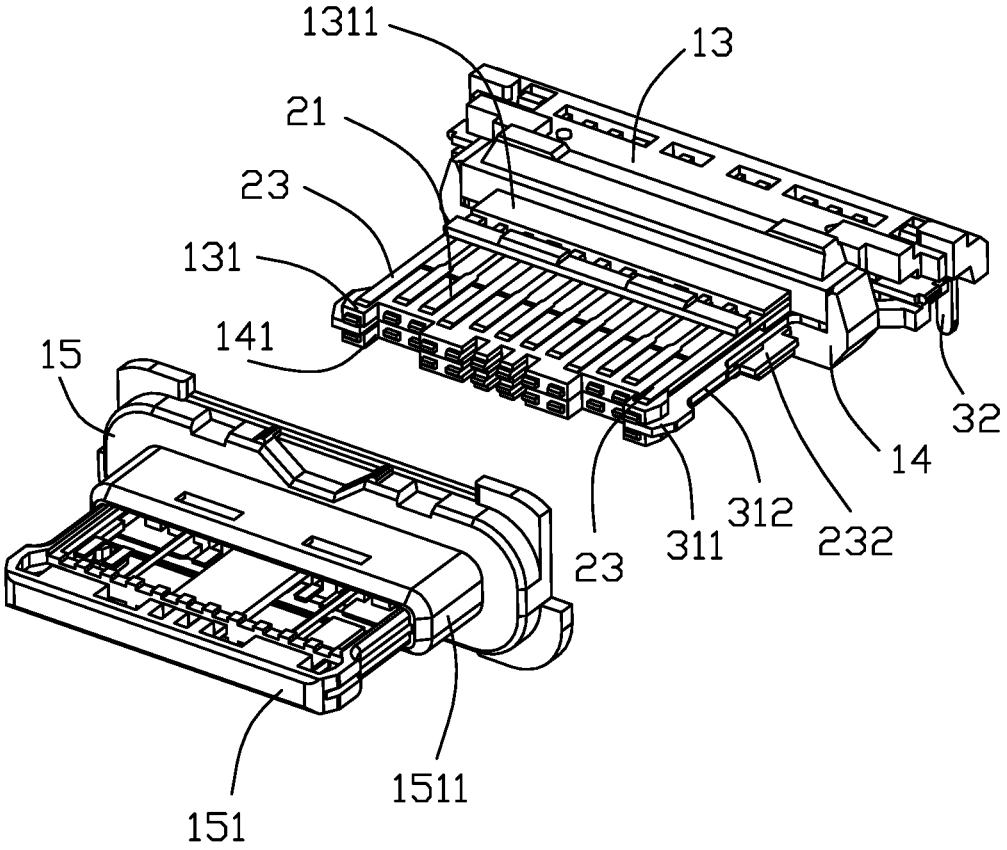
FIG. 6 is a front exploded perspective view of the contact module of the electrical connector of FIG. 5.
Figure 7:
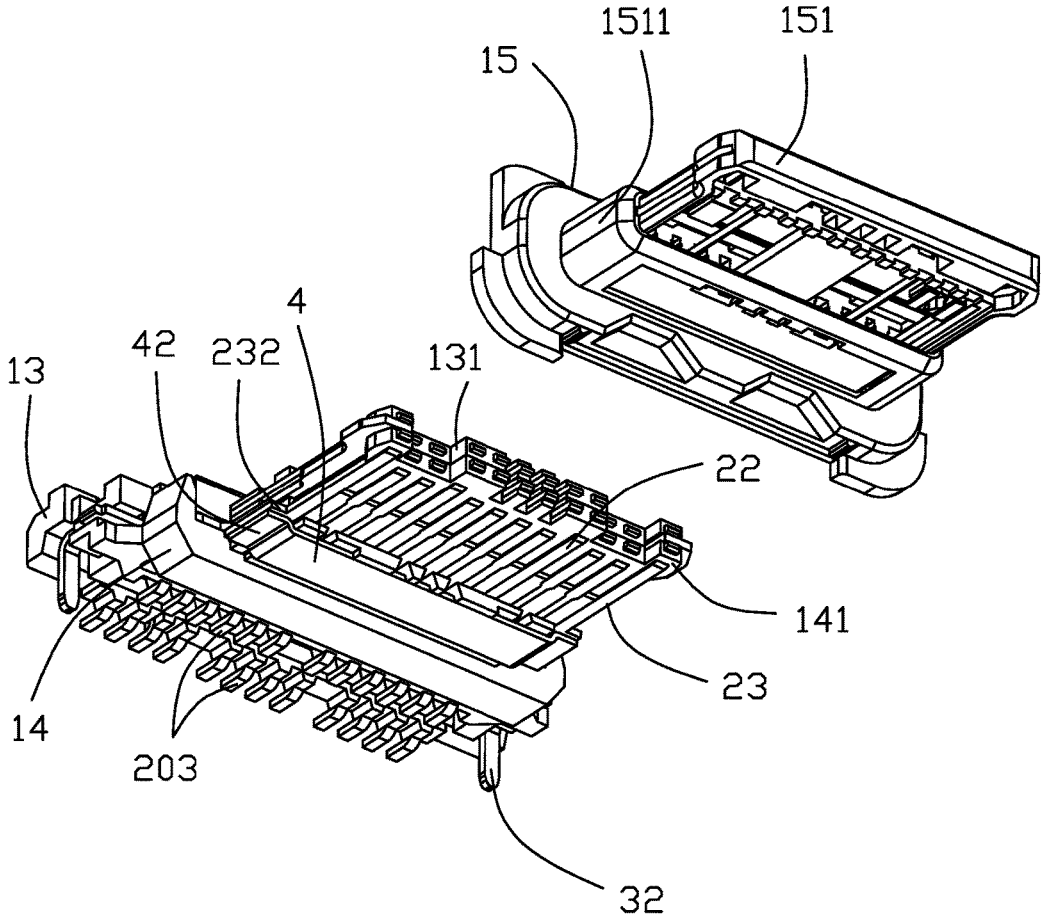
FIG. 7 is a rear exploded perspective view of the contact module of the electrical connector of FIG. 5
Figure 8:
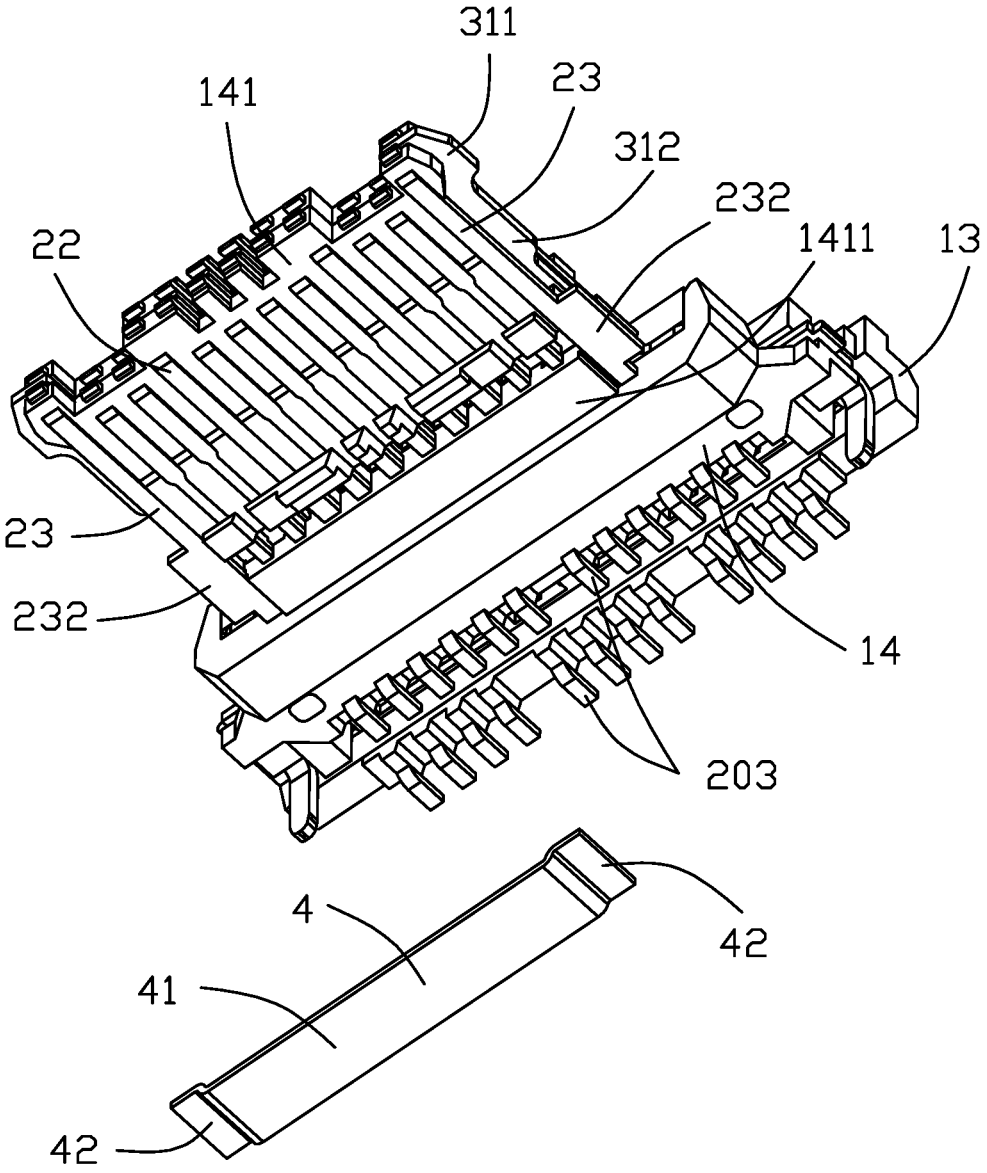
FIG. 8 is a further exploded perspective view of a part of the contact module of the electrical connector of FIG. 7.
Figure 9:
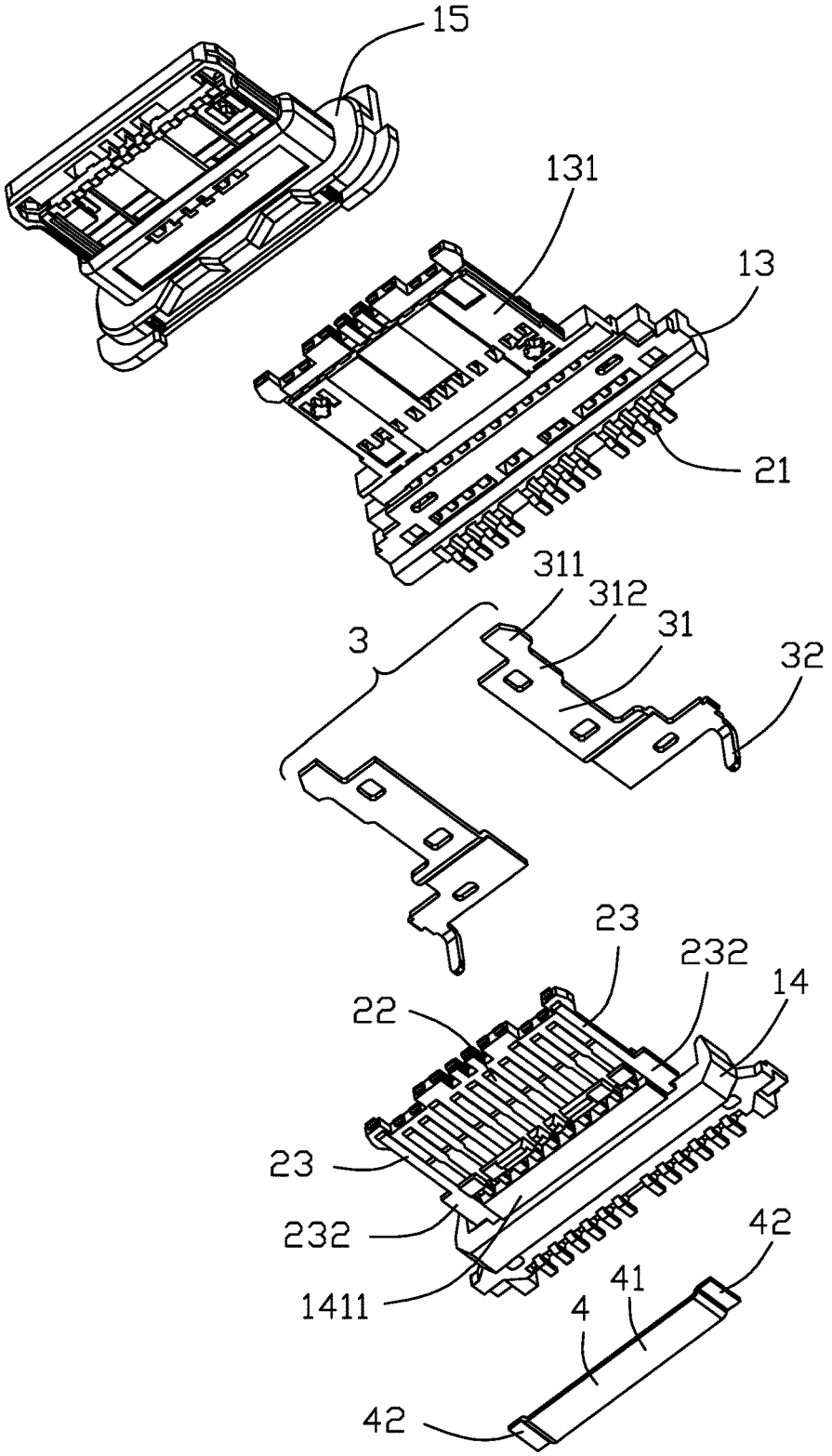
FIG. 9 is a further exploded perspective view of the contact module of the electrical connector of FIG. 7.
Figure 10:
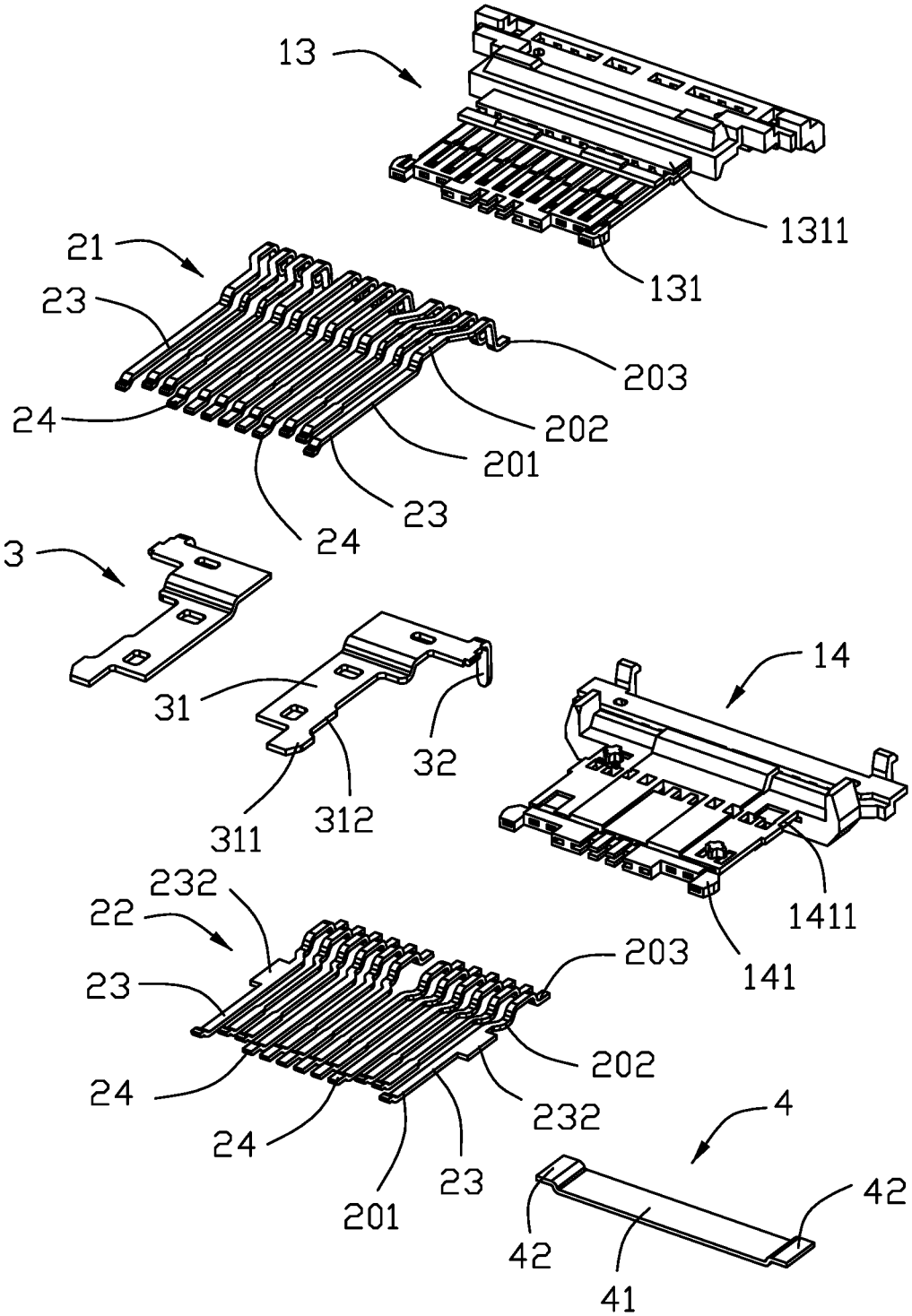
FIG. 10 is a further exploded perspective view of the contact module of the electrical connector of FIG. 8.
Figure 11:
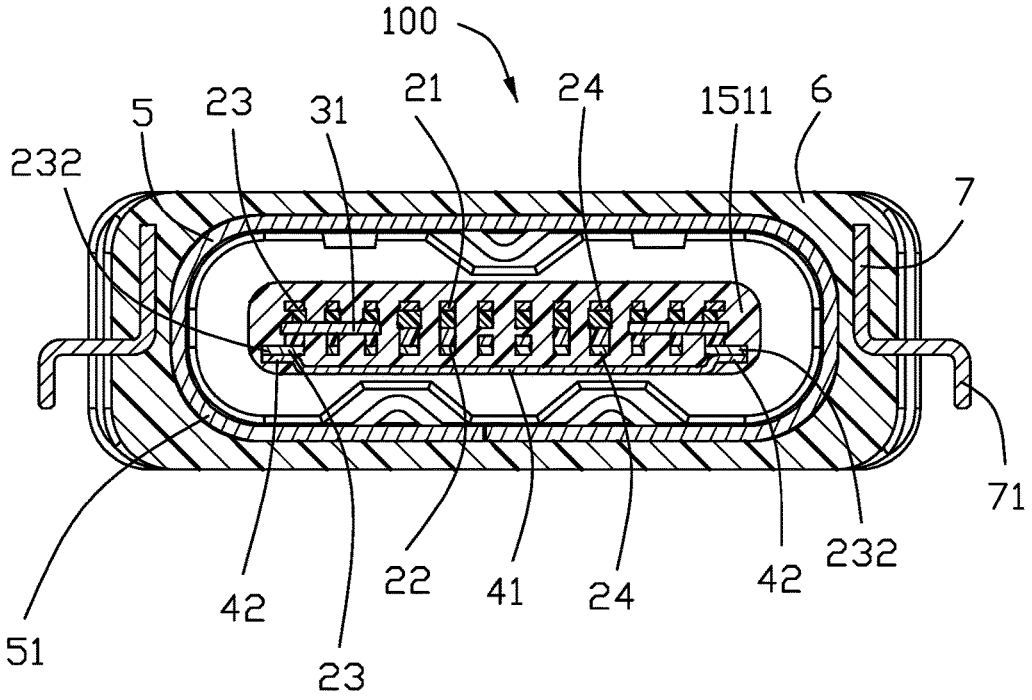
FIG. 11 is a cross-sectional view of the electrical connector of FIG. 1.

Referring to FIGS. 3, 4 and 11, the shield 5 is metallic and includes a tubular section 51 and a pair of side walls 52 wherein the tubular section 51 forms a receiving space 510. The portion of the housing 1 is received within the receiving space 510. The pair of side walls 52 are located behind the base 11 for mounting to the printed circuit board (not shown). The securement between the housing 1 and the shield 5 via some protrusions on the shield 5 to sandwich the housing 1 between the front-to-back direction as shown in the drawings.

Referring to FIGS. 1-4 and 11, the insulative cover 6 are integrally formed with the pair of mounting legs 7 via an insert-molding process. Each mounting leg 7 has a supporting leg 71 sidewardly exposed outside of the insulative cover 6, and a rearwardly exposed securing arm 72. The insulative cover 6 encloses the shield 5 with the securing arm 72 sandwiching the rear end of the base 11 for retention. The supporting leg 71 is to mount to the printed circuit board (not shown). The securing arm 72 is soldered with the corresponding side wall 52 not only for grounding with the shield 5 but also for securing the cover 6 to the shield 5 and the associated housing 1

Referring to FIGS. 1-4, the electrical connector 100 further includes a waterproof ring 8 surrounding the front end of the cover 6, and a waterproof plate 9 attached behind the housing 1 within the shield 5.

Referring to FIGS. 1-11, in the grounding contact 23 of the lower contacts 22, the retaining section 202 further includes a lateral extension 232 to mechanically and electrically connect to the grounding plate 4. The lateral extensions 232 are exposed outside of the second step 1411. Notably, the lateral extension 231 may be applied to the grounding contact 23 of the upper contacts 21. After assembled, the pair of coupling parts 42 abut against and are soldered to the lateral extensions 232 of the pair of grounding contacts 23 of the lower contacts 22, respectively, as shown in FIG. 11.

Figure 12:
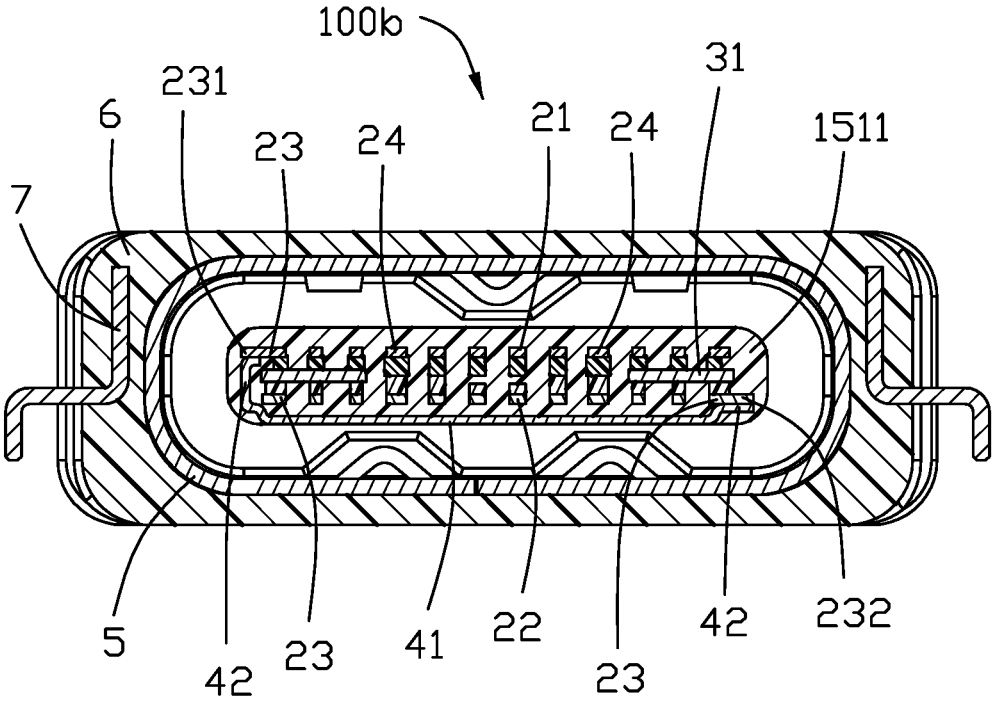
FIG. 12 is a cross-sectional view of an electrical connector according to a second embodiment of the invention.

Referring to FIG. 12, in the electrical connector **100*b* the grounding contact 23 of the upper contacts 21 has a first lateral extension 231 and the grounding contact 23 of the lower contacts 22 has the second lateral extension 232 on two opposite sides, respectively. The pair of coupling parts 42 abut against and are soldered to the lateral extension 231 and extension 232**, respectively.

Figure 13:
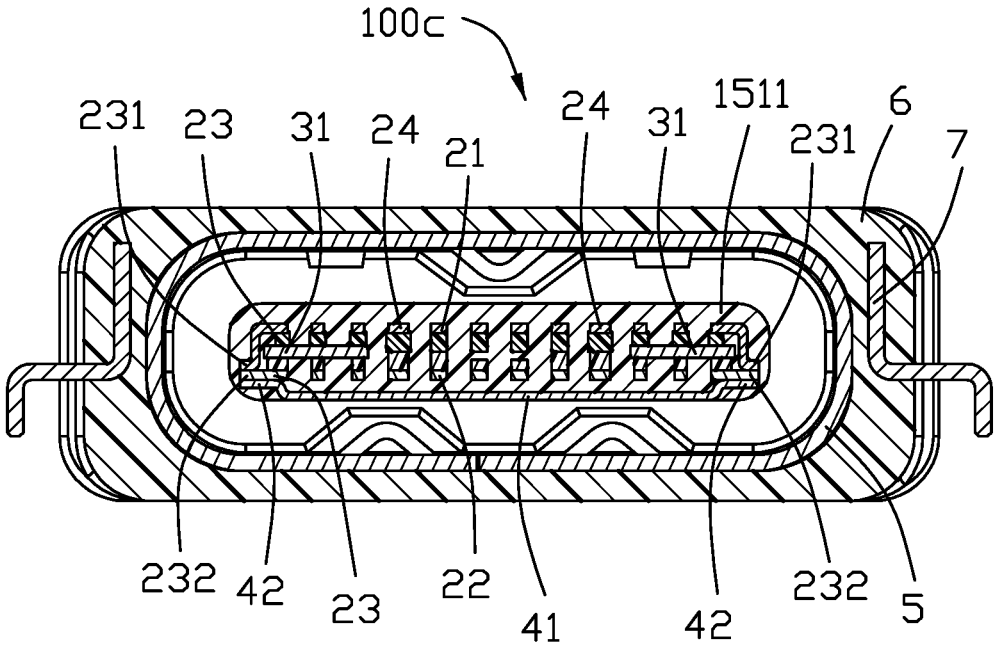
FIG. 13 is a cross-sectional view of an electrical connector according to a third embodiment of the invention.

Referring to FIG. 13, in the electrical connector **100*c*, the lateral extensions 231 and the lateral extension 232 abut against and are soldered with each other while the lateral extensions 232 are further soldered with the coupling parts 42. Notably, the coupling parts 42 can be soldered to the lateral extensions 231**.

Figure 14:
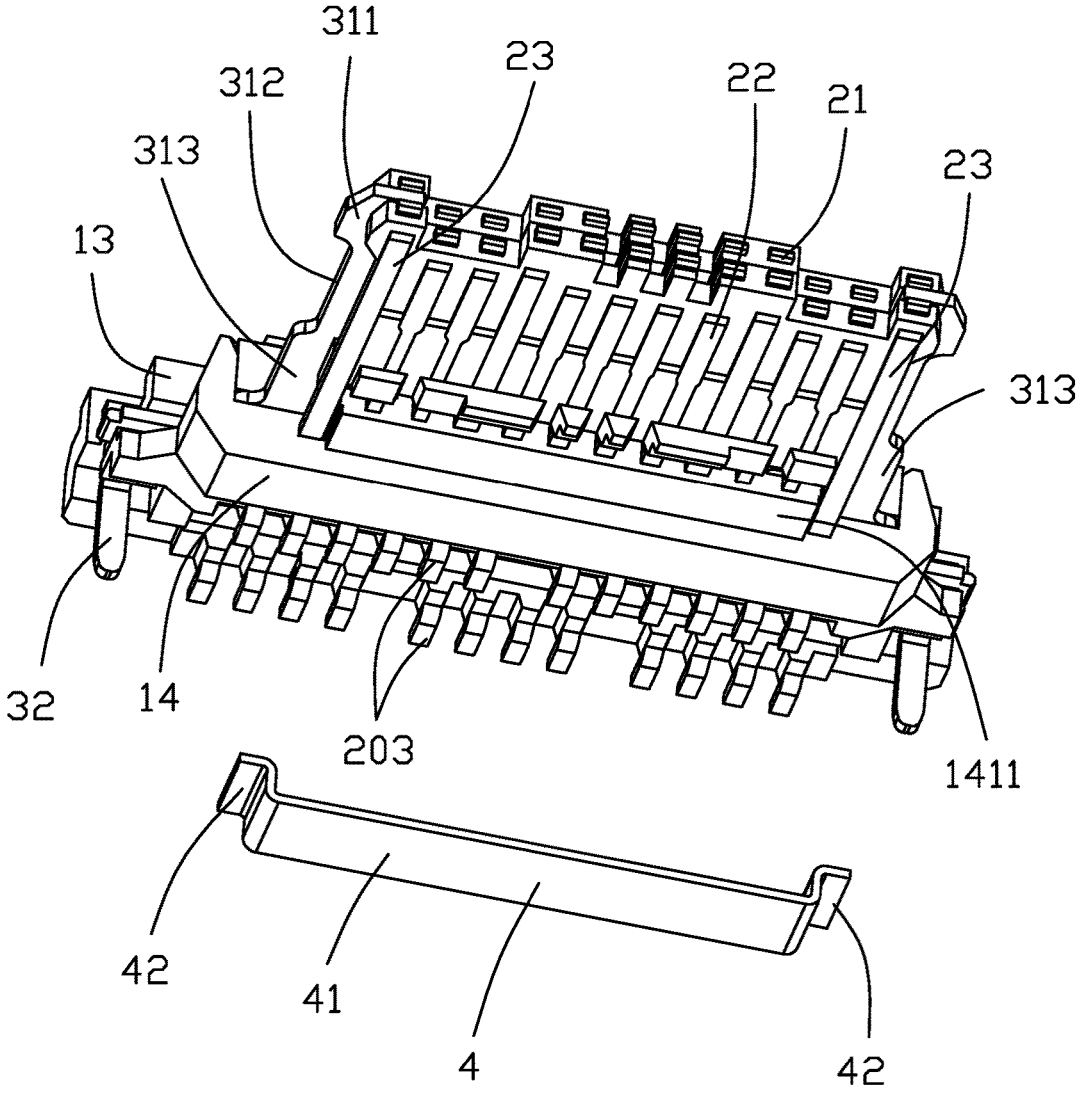
FIG. 14 is a perspective view of a part of an electrical connector according to a fourth embodiment of the invention.
Figure 15:
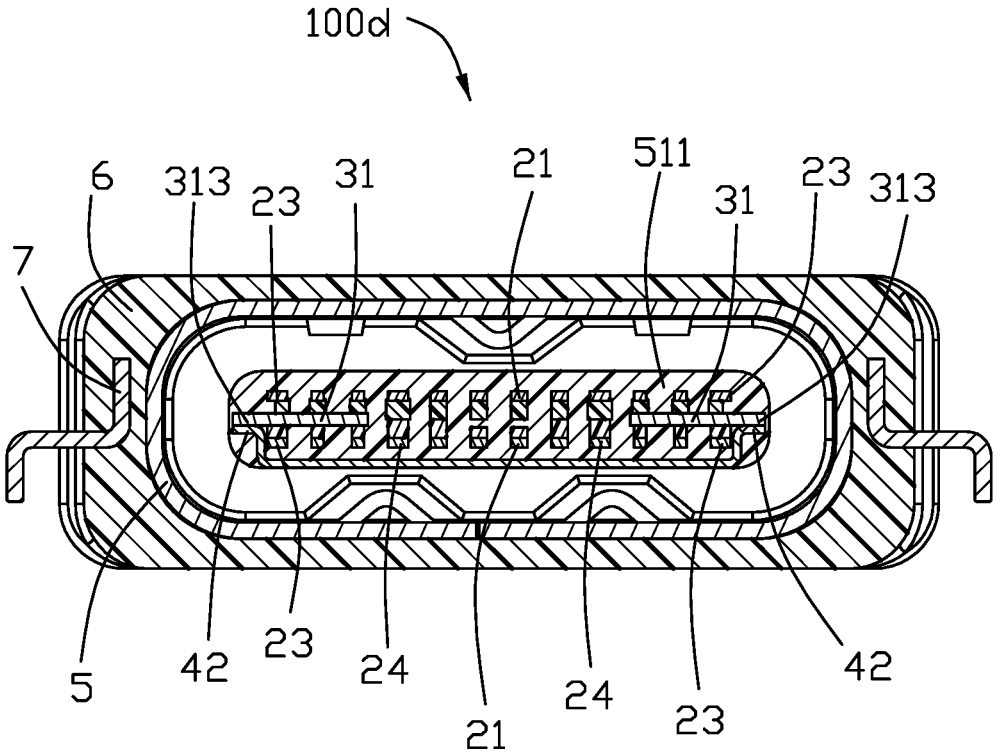
FIG. 15 is a cross-sectional view of the electrical connector of FIG. 14.

Referring to FIGS. 14 and 15, in the electrical connector **100*d*, the shielding plate 3 forms a pair of third lateral extensions 313. After assembled, the lateral extensions 313 are exposed and mechanically and electrically connected by and soldered to the coupling parts 42**.

Figure 16:
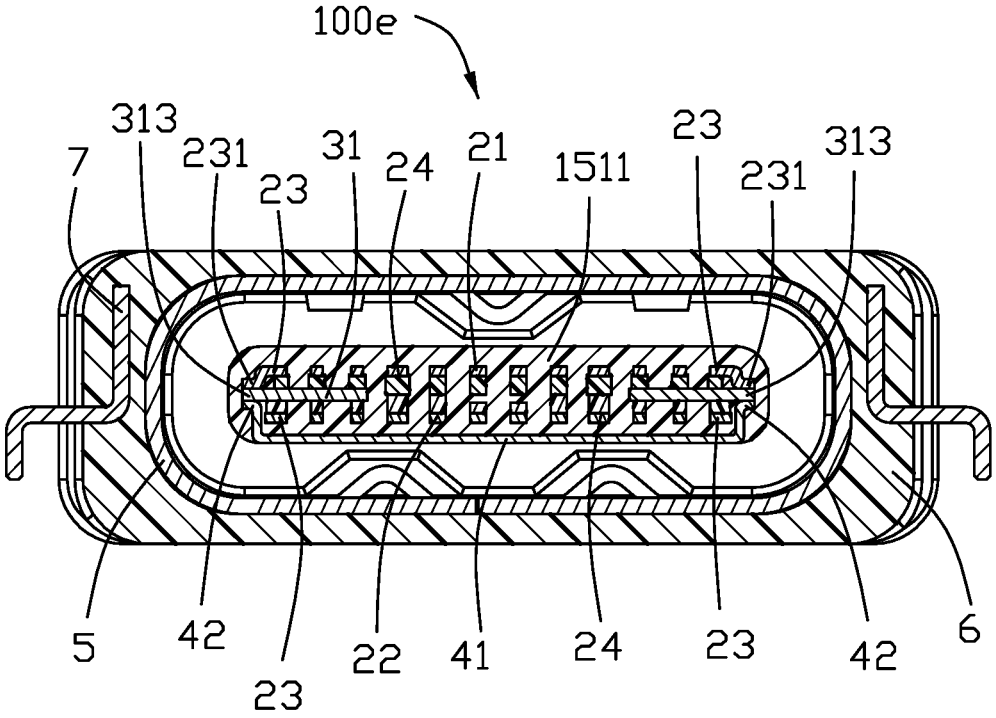
FIG. 16 is a cross-sectional view of the electrical connector according to a fifth embodiment of the invention.

Referring to FIG. 16, in the electrical connector **100*e*, similar to the fourth embodiment, the shielding plate 3 forms a pair of third lateral extensions 313 to which the coupling parts 42 is mechanically and electrically connected. In addition, the grounding contacts 23 of the upper contacts 21 further form a pair of first lateral extensions 231 also soldered to the third lateral extensions 313**.

Figure 17:
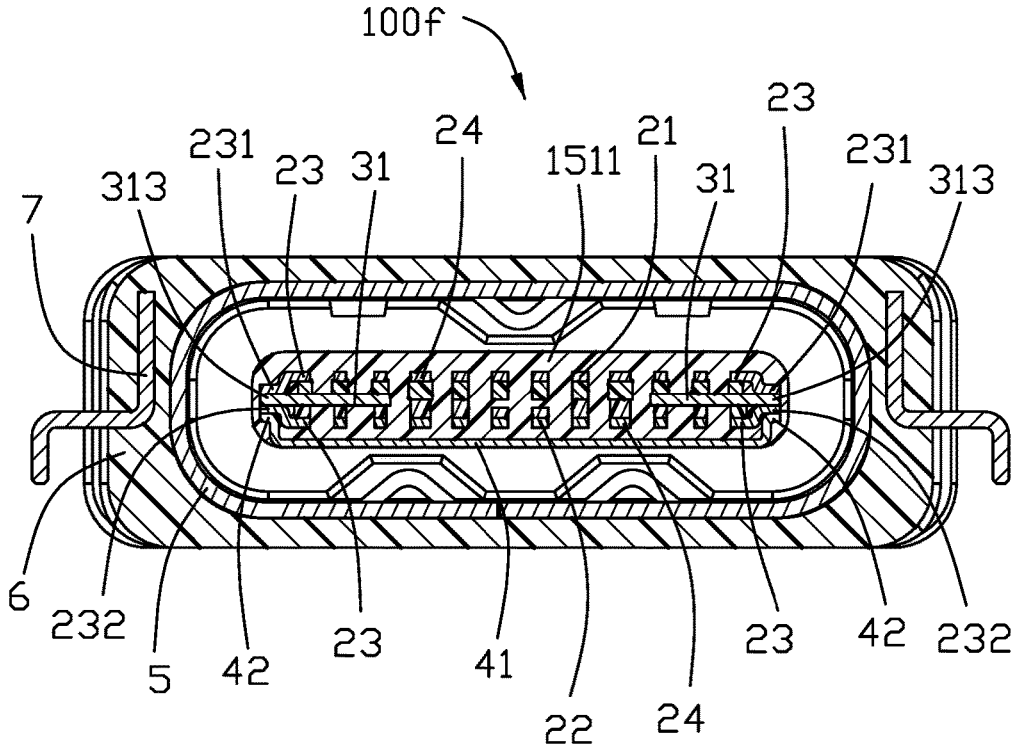
FIG. 17 is a cross-sectional view of the electrical connector according to a sixth embodiment of the invention.

Referring to FIG. 17, in the electrical connector **100*f*, compared to the fifth embodiment, the additional second lateral extensions 232 are connected between the coupling parts 42 and the third lateral extensions 313, instead of directly soldering the coupling parts 42 to the third lateral extensions 313**.

In brief, all embodiments show the coupling parts 42 of the grounding plate 4 mechanically connected, by soldering, to at least one of the shielding plate 3 and the grounding contacts wherein the shielding plate or the grounding contacts have corresponding extensions laterally exposed outside of the upper unit and the lower unit to be coupled with the coupling part 42. Notably, the grounding plate 4 may be paired in opposite vertical directions of the contact module.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a metallic shell;

a contact module enclosed in the metallic shell and including an insulative housing and a plurality of contacts and a shielding plate retained in the housing, said contacts including a plurality of outermost grounding contacts in a transverse direction, said shielding plate including a locking recess exposed in the transverse direction;

the housing including a base and a tongue portion forwardly extending from the base, the tongue portion including a front mating section on which contacting sections of the contacts are exposed, and a rear step section linked to the base; and a grounding plate attached to the step section and including a main part exposed to an exterior in a vertical direction perpendicular to said transverse direction, and at least one coupling part on a lateral side of the main part in said transverse direction; wherein said coupling part is electrically and mechanically connected to at least one of the shielding plate and the grounding contacts; and the shielding plate has a lateral extension, and at least one of the grounding contacts has another lateral extension aligned with said lateral extension in said vertical direction, and all the coupling part, said lateral extension and said another lateral extension are permanently secured together.

2. The electrical connector as claimed in claim 1, wherein the grounding contact in an upper row and the grounding contact in a lower row have corresponding lateral extensions permanently secured to each other and further to the coupling part.

3. The electrical connector as claimed in claim 1, wherein the grounding plate further includes another coupling part on an opposite lateral side opposite to the coupling part.

4. The electrical connector as claimed in claim 3, wherein said coupling part is mechanically and electrically connected to a corresponding grounding contact in one row while said another coupling part is mechanically and electrically connected to another corresponding grounding contact in another row.

5. The electrically connector as claimed in claim 3, wherein said coupling part is mechanically and electrically connected to a corresponding grounding contact in one row, and said another coupling part is mechanically and electrically connected to another corresponding grounding contact in said one row.

6. The electrical connector as claimed in claim 3, wherein said another coupling part is mechanically and electrically connected to at least one of the shielding plate and the grounding contacts.

7. The electrical connector as claimed in claim 1, wherein all the coupling part, said lateral extension and said another lateral extension are aligned together in the vertical direction so as to be secured together at a same position viewed in said vertical direction.

8. The electrical connector as claimed in claim 7, wherein said lateral extension is sandwiched between said another lateral extension and said coupling part in the vertical direction, or said another lateral extension is sandwiched between said lateral extension and said coupling part in the vertical direction.

9. An electrical connector comprising:

a metallic shell;

a contact module enclosed in the metallic shell and including an insulative housing and a plurality of contacts and a shielding plate retained in the housing, said contacts including a plurality of outermost grounding contacts in a transverse direction, said shielding plate including a locking recess exposed in the transverse direction;

the housing including a base and a tongue portion forwardly extending from the base, the tongue portion including a front mating section on which contacting sections of the contacts are exposed, and a rear step section linked to the base; and a grounding plate attached to the step section and including a main part exposed to an exterior in a vertical direction perpendicular to said transverse direction, and at least one coupling part on a lateral side of the main part in said transverse direction; wherein at least one of the shielding plate and one outmost grounding contact has one lateral extension located around said lateral side and aligned with and permanently secured to the coupling part in said vertical direction.

10. The electrical connector as claimed in claim 9, wherein both the coupling part and the lateral extension are enclosed within the housing.

11. The electrical connector as claimed in claim 9, wherein both the shielding plate and said one outmost grounding contact have the corresponding lateral extensions and commonly permanently secured to the coupling part.

12. The electrical connector as claimed in claim 9, wherein both the shielding plate and two outmost grounding contacts have the corresponding lateral extension and commonly permanently secured to the coupling part, and the lateral extension of the shielding plate is sandwiched between those of said two grounding contacts in the vertical direction.

13. The electrical connector as claimed in claim 9, wherein the coupling part is offset from the main part in the vertical direction so as to be hidden under the housing while the main part is exposed to an exterior.

* * * * *